US011083952B2

(12) United States Patent
Cho et al.

(10) Patent No.: US 11,083,952 B2
(45) Date of Patent: Aug. 10, 2021

(54) MULTI-SPORT AND MULTI-COURT STRUCTURE CAPABLE OF AUTOMATICALLY COLLECTING AND SUPPLYING BALL

(71) Applicants: Byoungkoo Cho, Daejeon (KR); Yeonuk Jeong, Seoul (KR); Bosub Kim, Daegu (KR)

(72) Inventors: Byoungkoo Cho, Daejeon (KR); Yeonuk Jeong, Seoul (KR); Bosub Kim, Daegu (KR)

( * ) Notice: Subject to any disclaimer, the term of this patent is extended or adjusted under 35 U.S.C. 154(b) by 0 days.

(21) Appl. No.: 17/045,804

(22) PCT Filed: Jul. 9, 2019

(86) PCT No.: PCT/KR2019/008420
§ 371 (c)(1),
(2) Date: Oct. 7, 2020

(87) PCT Pub. No.: WO2020/013573
PCT Pub. Date: Jan. 16, 2020

(65) Prior Publication Data

US 2021/0052965 A1 Feb. 25, 2021

(30) Foreign Application Priority Data

Jul. 10, 2018 (KR) ..... 10-2018-0080172
Jul. 10, 2018 (KR) ..... 10-2018-0080177
Jul. 8, 2019 (KR) ..... 10-2019-0082182

(51) Int. Cl.
*A63B 61/00* (2006.01)
*A63B 69/40* (2006.01)
(Continued)

(52) U.S. Cl.
CPC ..... *A63B 69/40* (2013.01); *A63B 43/004* (2013.01); *A63B 47/025* (2013.01);
(Continued)

(58) Field of Classification Search
CPC ..... A63B 69/40; A63B 43/004; A63B 47/025; A63B 61/003; A63B 63/083;
(Continued)

(56) References Cited

U.S. PATENT DOCUMENTS 4,307,887 A * 12/1981 Weiss ..... A63B 67/007 473/466
4,762,319 A * 8/1988 Krumholz ..... A63B 63/08 473/416
(Continued)

FOREIGN PATENT DOCUMENTS

CN 202892838 U 4/2013
JP 2003-339918 A 12/2003
(Continued)

*Primary Examiner* — Mitra Aryanpour
(74) *Attorney, Agent, or Firm* — KORUS Patent, LLC; Seong Il Jeong

(57) ABSTRACT

The present invention proposes a court, which is a half- or full-court in which ball sports, such as soccer (penalty kicks), foot volleyball, volleyball, and basketball (3×3 basketball), can be played. The court allows balls to be automatically and rapidly supplied in the case where it takes time to resume a game, such as a case where a game is replayed or a case where a ball is out according to the characteristics of each type of sport, or in the case where serve-reception practice is required, and also allows balls to be naturally collected and lifted because the court is inclined and allows the balls to be automatically classified according to the types of balls and to be supplied to the court.

4 Claims, 5 Drawing Sheets

(51) Int. Cl.
*A63B 43/00* (2006.01)
*A63B 47/02* (2006.01)
*A63B 63/08* (2006.01)
*A63B 69/00* (2006.01)

(52) U.S. Cl.
CPC ..... *A63B 61/003* (2013.01); *A63B 63/083* (2013.01); *A63B 69/002* (2013.01); *A63B 69/0071* (2013.01); *A63B 69/0095* (2013.01); *A63B 2225/54* (2013.01); *A63B 2225/74* (2020.08)

(58) Field of Classification Search
CPC ..... A63B 69/002; A63B 69/0071; A63B 69/0095; A63B 2225/74; A63B 2225/54
USPC ..... 473/416, 415, 465, 473, 474, 477, 478, 473/490
See application file for complete search history.

(56) References Cited

U.S. PATENT DOCUMENTS 4,786,053 A * 11/1988 Barnes, Jr. ..... A63B 71/023 473/416
5,513,843 A * 5/1996 Russell ..... A63B 63/004 473/416
5,558,338 A * 9/1996 Taub ..... A63B 69/0071 473/416
5,584,480 A * 12/1996 Grimsrud ..... A63B 71/023 473/447
5,613,676 A * 3/1997 Connolly ..... A63B 63/004 473/416
5,816,953 A * 10/1998 Cleveland ..... A63B 69/38 473/459
7,247,105 B2 * 7/2007 Huntsberger ..... A63B 24/0021 473/433
7,351,168 B1 * 4/2008 Pannell ..... A63B 63/004 473/476
7,731,610 B2 * 6/2010 Im ..... A63B 63/004 473/476
8,172,707 B2 * 5/2012 Cox ..... A63B 61/02 473/492
8,262,517 B2 * 9/2012 Balasubramanyan ..... A63B 69/385 473/459
8,475,301 B1 * 7/2013 Lane ..... A63B 71/023 473/416
8,974,312 B2 * 3/2015 Cho ..... A63B 57/0006 473/132
9,283,431 B2 * 3/2016 Marty ..... A63B 69/38 473/468
2015/0057114 A1 * 2/2015 Ehasoo ..... A63B 61/02 473/492
2015/0072808 A1 * 3/2015 Annoni ..... A63C 19/12 473/504
2020/0398145 A1 * 12/2020 Cho ..... A63C 19/02 473/415

FOREIGN PATENT DOCUMENTS

KR 10-1984-0001361 A 4/1984
KR 10-1998-036877 A 8/1998
KR 20-0255994 U 2/1999
KR 20-1999-0008714 U 3/1999
KR 20-0219853 Y1 4/2001
KR 10-1564190 B1 11/2015
KR 10-1600761 B1 3/2016
KR 10-1622889 B1 5/2016
KR 10-1622890 B1 5/2016

* cited by examiner

MULTI-SPORT AND MULTI-COURT STRUCTURE CAPABLE OF AUTOMATICALLY COLLECTING AND SUPPLYING BALL

TECHNICAL FIELD

The present invention relates to a multi-sport and multi-court that is capable of automatically collecting and supplying balls.

BACKGROUND ART

Currently, each of most sports courts is specific to a single sport. Even in the case where a court is used for several types of sports, this case is intended to overcome the lack of space, and various lines are present on the court in a mixed manner. No scientific and efficient multi-sport court has been proposed that includes a ball supply device. In the case of using a multi-sport game court, a device that can classify and supply balls for each type of sport must also be provided in order to appropriately use ball collection and supply devices.

DISCLOSURE

Technical Problem

Therefore, an object of the present invention is to provide a scientific, spatial utilization-optimized sports court in which games of multiple sports can be played.

An object of the present invention is to provide a multi-sport court that can classify and automatically supply balls for each specific type of sport when games of multiple sports are played.

Technical Solution

The present invention proposes a half- or full-court capable of the playing of a variety of sports such as soccer (penalty kicks), foot volleyball, volleyball, and basketball (3×3 basketball).

According to the characteristics of each sport, soccer, basketball, volleyball and foot volleyball balls are supplied above a basketball goal. In addition, volleyball and football balls are shot from a side of a court toward the center of a net, thereby allowing reception practice to be done. In the case where it takes time to resume a game, such as a case where a score is obtained and a game is replayed in a neutral state or a case where a ball is out, a ball can be supplied automatically and rapidly.

A slight inclination is formed on a court, so that balls are automatically collected and lifted without disturbing a game and are automatically classified according to their type and supplied to the court.

A chip acting as an electronic signal sensor configured to identify the type of ball is embedded in a ball. The chip varies depending on the type of ball. When a ball is supplied, a chip embedded in the ball is identified, and the ball is supplied through a different gate according to the type of ball.

An embodiment of the present invention provides a multi-sport court capable of automatically collecting and supplying balls, wherein the court includes a ground inclined in one direction, a net is detachably installed between a pair of center posts on the ground, a soccer goal is installed in a center of one side of the ground, a basketball goal is installed on a center of an upper portion of the soccer goal in an integrated manner, a concave ball transfer line inclined in a horizontal direction is formed on an end line of the ground on which the soccer goal is installed, a ball lifting device configured to lift a ball vertically is installed to communicate with the ball transfer line, an upper end of the ball lifting device communicates with one end of a ball distribution line horizontally extending at an aerial height and inclined in a direction opposite to a direction in which the ball transfer line is inclined, a plurality of gates is installed at appropriate intervals on the ball distribution line, and an end of the ball distribution line communicates with a ball shooting device configured to shoot a volleyball ball or foot volleyball ball as a served ball.

Advantageous Effects

According to the present invention, various ball sports can be scientifically and systematically practices and enjoyed on a single court without being subordinated to a single type of sport.

The supply and transfer of balls on the court are performed automatically, and various ball sports can be enjoyed in parallel.

MODE FOR INVENTION

Figure 1:
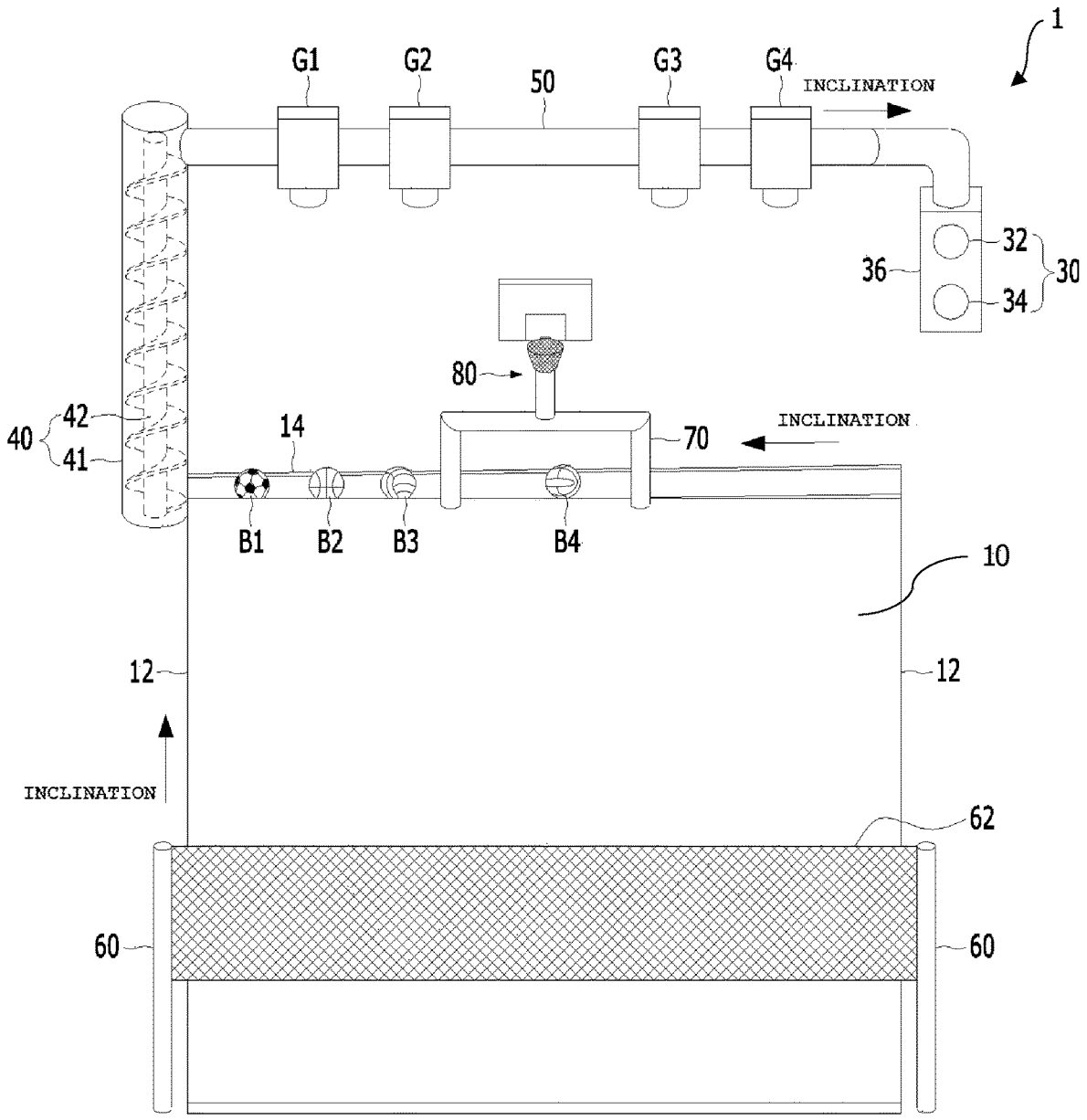
FIG. 1 is an overall perspective view of a multi-sport court according to the present invention.

Some embodiments of the present invention will be described below in detail through the exemplary drawings. It should be noted that when assigning reference numerals to components of the drawings, the same components are assigned the same reference numerals as much as possible even when they are shown in different drawings. In addition, in the following description of the present embodiment, when it is determined that a detailed description of a related well-known configuration or function may obscure the gist of the present embodiment, the detailed description will be omitted.

In the following description of the components of the present embodiment, signs such as first, second, a), b), etc. may be used. These signs are used to distinguish corresponding components from other components, and the nature, sequential positions, or order positions of the corresponding components are not limited by the signs. In addition, when a part in the specification is described as "including" or "having" a component, this means that the part may further include another component rather than excluding another component unless explicitly stated to the contrary. In addition, when the term "connection," "installation" or "attachment" is used in the specification, this does not mean only direct connection, direct installation or direct attachment between components, but it should be interpreted as including both indirect connection, indirect installation or indirect attachment and connection, installation or attachment through another component as broadly as possible.

FIG. 1 is an overall perspective view of a multi-sport court 1 according to the present invention. This is a half-court type multi-sport court capable of supporting penalty kicks of soccer, foot volleyball, volleyball, and 3×3 basketball. It is preferable that the length and width of the half-court are 14 m (45.93') and 15 m (49.21'), respectively. A full-court has a dimension of 28 m (91.6')×15 m (49.21'). In particular, it is preferable to extend the half-court to the full-court for foot volleyball or volleyball.

The multi-sport court 1 includes a ground 10 that is a sports field. Both left and right sides of the ground 10 end with boundary lines 12.

A pair of center posts 60 are located on the lower side of the ground 10, i.e., the lower corners of FIG. 1. A net 62 is detachably mounted between the center posts 60. A user may raise the net 62 when playing volleyball, and may lower the net 62 when playing foot volleyball. The net 62 may be used as a tennis net. In this way, the height of the net may be adjusted to a higher location and a lower location. As will be described later, serve balls for the serve/receive practice of volleyball or foot volleyball may be supplied over the net.

A soccer goal 70 is installed on the top side of the ground 10, i.e., at the center of the end line of FIG. 1. A basketball goal 80 is installed at the center of the top portion of the soccer goal 70. The soccer goal 70 and the basketball goal 80 are fabricated in an integrated manner according to game rules.

LED lines may be disposed on the floor of the multi-sport court 1, and sport areas/zones may be marked by forming various colored lines.

A ball transfer line 14 that is concave in a horizontal direction is formed across the top side of the ground 10 on which the soccer goal 70 is installed. The ball transfer line 14 is preferably formed along an outline of the ground so as not to interfere with a game.

According to the present invention, the ground 10 is formed to be inclined downward toward the top and downward toward the left, as shown by the arrows. The inclined area may be created by cutting the ground or by constructing a dedicated playground. It is preferable that an inclination angle is 0.00872665 rad to 0.02617994 rad (0.5° to 1.5°). A method of constructing an inclined court is disclosed, for example, in U.S. patent application Ser. No. 16/028,613 of the present applicant.

According to the present invention, when a user repeatedly practices using several balls, the balls that have fallen to the ground 10 are automatically collected to the ball transfer line 14 and moved to the left side of the drawing. In the illustrated example, it is shown that a soccer ball B1, a basketball ball B2, a volleyball ball B3, and a foot volleyball ball B4 are collected in the ball transfer line 14.

One end of the ball transfer line 14 is connected to a ball lifting device 40. The ball lifting device 40 includes a lifting post 41 and a screw 42 vertically installed inside the lifting post 41. The detailed configuration of the ball lifting device 40 is disclosed, for example, in Korean Patent No. 10-1977362 of the present applicant.

The upper end of the lifting post 40 communicates with one end of a ball distribution line 50 horizontally extending at an aerial height above the basketball goal 80. When viewed from above, the ball distribution line 50 may be superimposed on the ball transfer line 14. The ball distribution line 50 is inclined toward the right unlike the ground 10. Accordingly, a ball having passed through the ball lifting device 40 moves to the right side of the drawing inside the ball distribution line 50. First to fourth gates G1, . . . , G4 are installed in four sites of the ball distribution line 50 at appropriate intervals. For example, a soccer ball, a basketball ball a volleyball ball, and a foot volleyball ball pass through the first gate G1, the second gate G2, the third gate G3, and the fourth gate G4, move and fall to the ground 10. To this end, according to the present invention, a chip is embedded inside each ball as an electronic signal sensor configured to identify the type of ball.

In order to adjust the location at which a ball falls to the ground, it may be possible to form an exit from which the ball comes out as a line while communicating with each gate and to allow the ball to fall, for example, behind an end line or near a center line.

The right end of the ball distribution line 50 communicates with the ball shooting device 30. The ball shooting device 30 is suspended in the air, and, for example, a first opening 32, which is a shooting exit for a volleyball ball, is formed in the upper part of a standby post 36 and a second opening 34, which is a shooting exit for a foot volleyball ball, is formed in the lower part of the standby post 36. In the case of volleyball and foot volleyball requiring serve-reception practice, a served ball may be strongly shoot over the net 62 using the ball shooting device 30 without distributing the ball. The configuration of the ball shooting device 30 is known, and any of the existing configurations may be adopted in the present invention.

In this case, it is obvious that the location at which a ball falls may also be adjusted using a method of extending a final exit for a ball via a line.

The above-described present invention of FIG. 1 is suitable for the training of a player who wants to increase training efficiency through the repetitive supply of balls as well as a general user.

Figure 2:
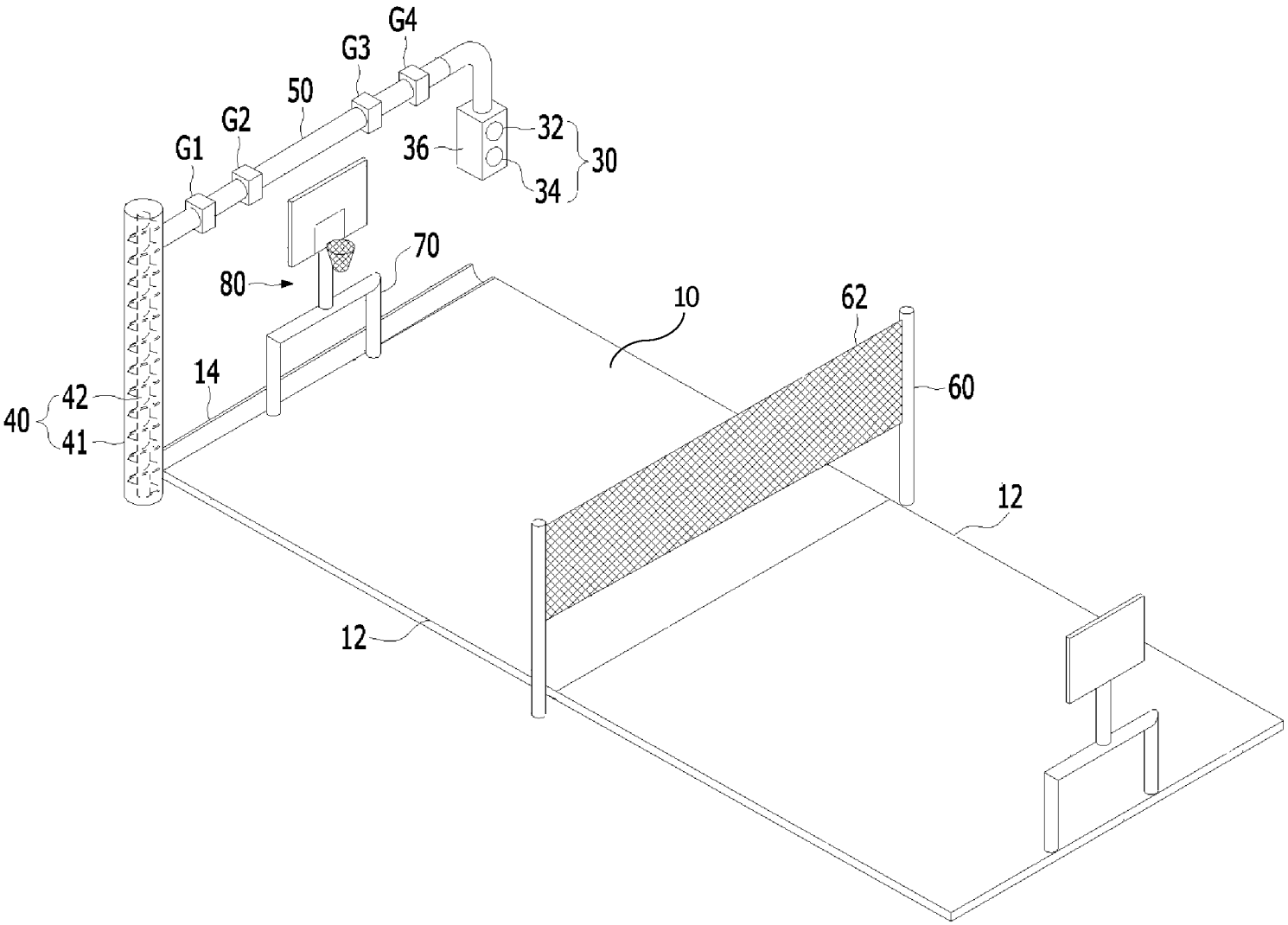
FIG. 2 is an overall perspective view showing the multi-sport court of the present invention that is implemented as a full-court.

FIG. 2 is an overall perspective view showing the multi-sport court 1 of the present invention that is implemented as a full-court. As in the half-court, a user may enjoy a formal game of a desirable sport without spatial restrictions while playing penalty kicks of soccer, foot volleyball, volleyball, and 3×3 basketball. The inclination angle of the ground 10 is 0.02617994 rad or less (1.5° or less), and this level of inclination falls within an appropriate range that does not give a user a physical burden or a sense of inclination attributable to the inclination.

Figure 5:
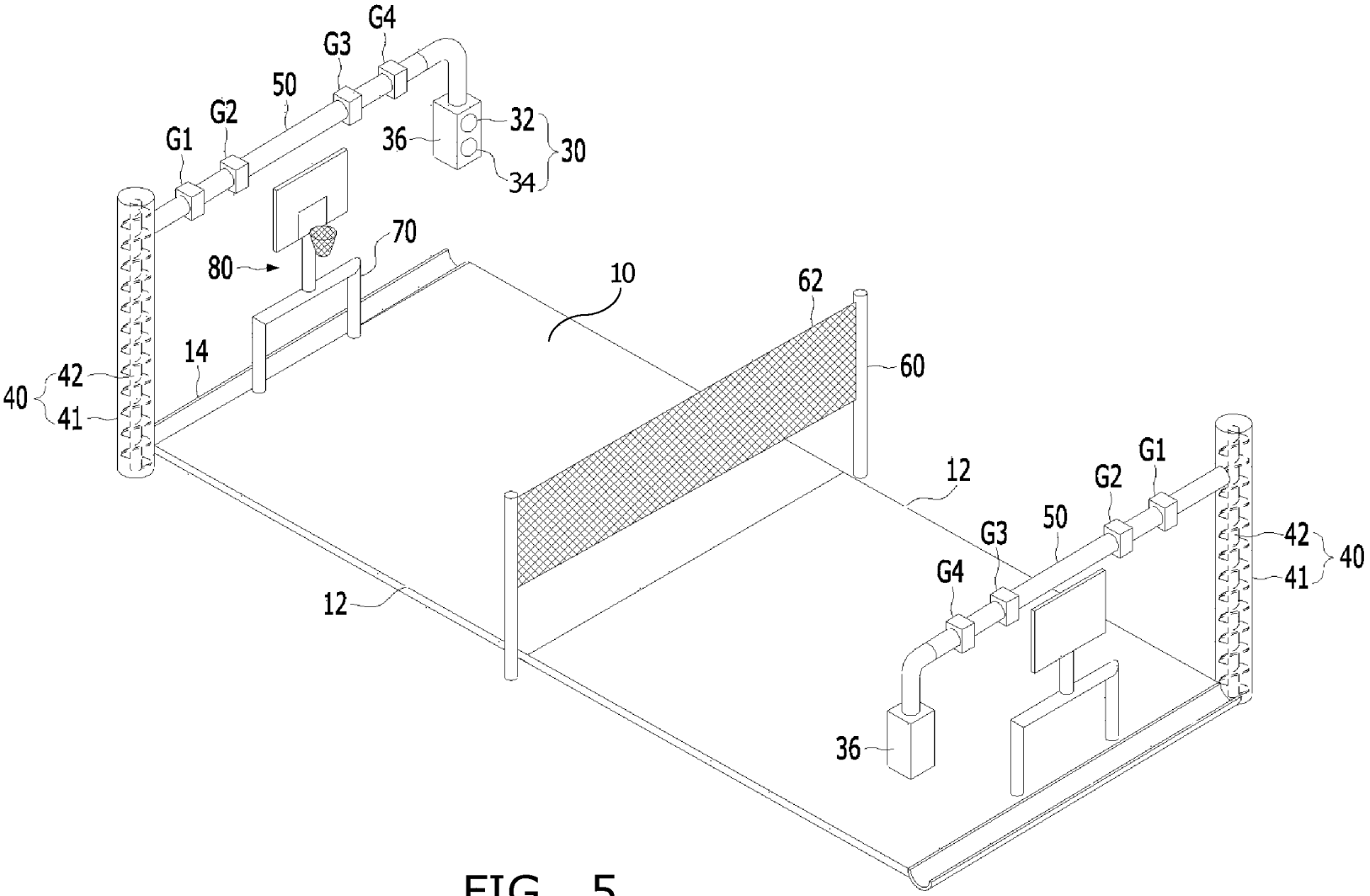
FIG. 5 is a view showing another embodiment of FIG. 2.

In FIG. 5, the multi-sport court 1 of the present invention is formed as a full-court, and the above-described ball transfer, lifting, distribution and shooting devices are installed on both end lines. In this case, the full-court may expect the same effects as the half-court while utilizing a wider ground.

In the present invention, the locations and number of goals for the training of multiple sports may be variously changed in such a manner that, for example, soccer goals are further installing on the left and right sides or the location of a soccer goal is changed. This does not limit the scope of the present invention.

Figure 3:
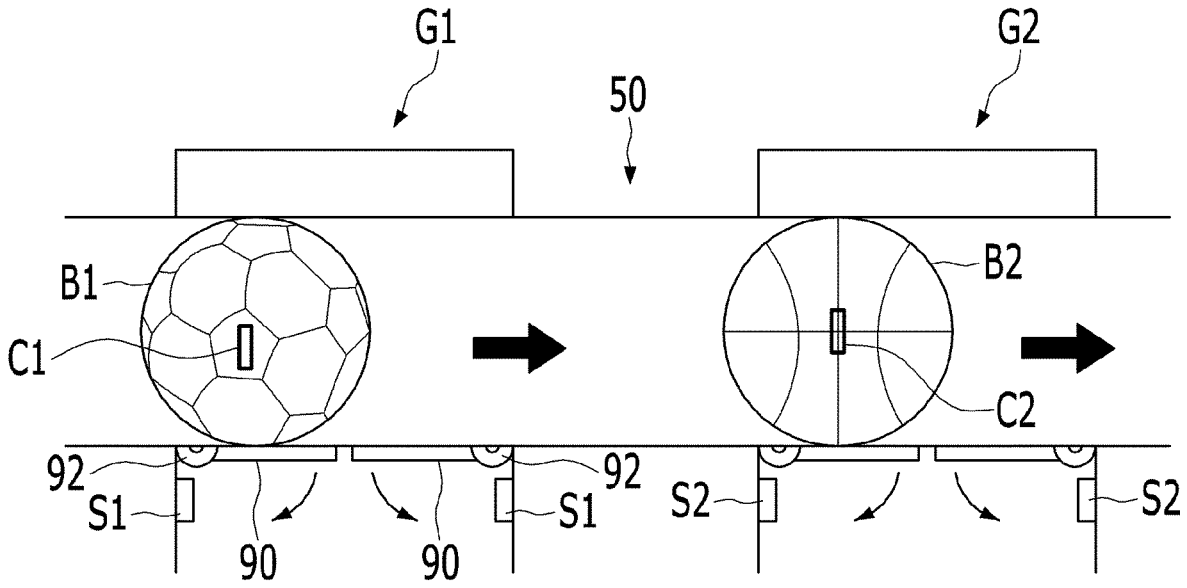
FIG. 3 is an internal diagram illustrating a gate structure installed in the ball distribution line of the present invention.

FIG. 3 is an internal view illustrating a gate structure installed in the ball distribution line 50 of the present invention. The first gate G1 is installed at one side of the ball distribution line 50. The first gate G1 includes a solenoid valve 92 provided on both sides of the passage of an exit, and a screen 90 configured to act as a partition that is rotated by the operation of the solenoid valve 92. A first sensor Si is attached to the side wall of an exit side near the solenoid valve 92. A chip C1 configured to allow a soccer ball to be identified is embedded inside the soccer ball B1, as described above. When the soccer ball B1 approaches, the first sensor Si identifies the chip C1 and opens the screen 90, and the soccer ball B1 passes through the first gate G1 and is supplied to the ground 10. After a predetermined period of time, the screen 90 is automatically closed. By repeating this operation, only the soccer ball B1 is selected and supplied through the first gate G1.

The second gate G2 has the same structure as the first gate G1, and as described above, only the basketball B2 in which a chip C2 configured to allow a basketball ball to be identified is embedded is selected and supplied to the ground 10.

According to the present invention, since an electronic chip acting as an identifier is embedded inside each ball, any ball may be collected and resupplied to a sports field when a user does exercise on a multi-sport court. According to the present invention, it is sufficient if only gates the exits of which have different diameters are installed for different balls having different sizes for respective sports, and thus manufacturing and maintenance are convenient. In addition, an advantage arises in that it is sufficient if the location at which a gate is installed horizontally is changed when it is necessary to change the location at which a ball is supplied according to the type of sport and the size of a court.

Figure 4:
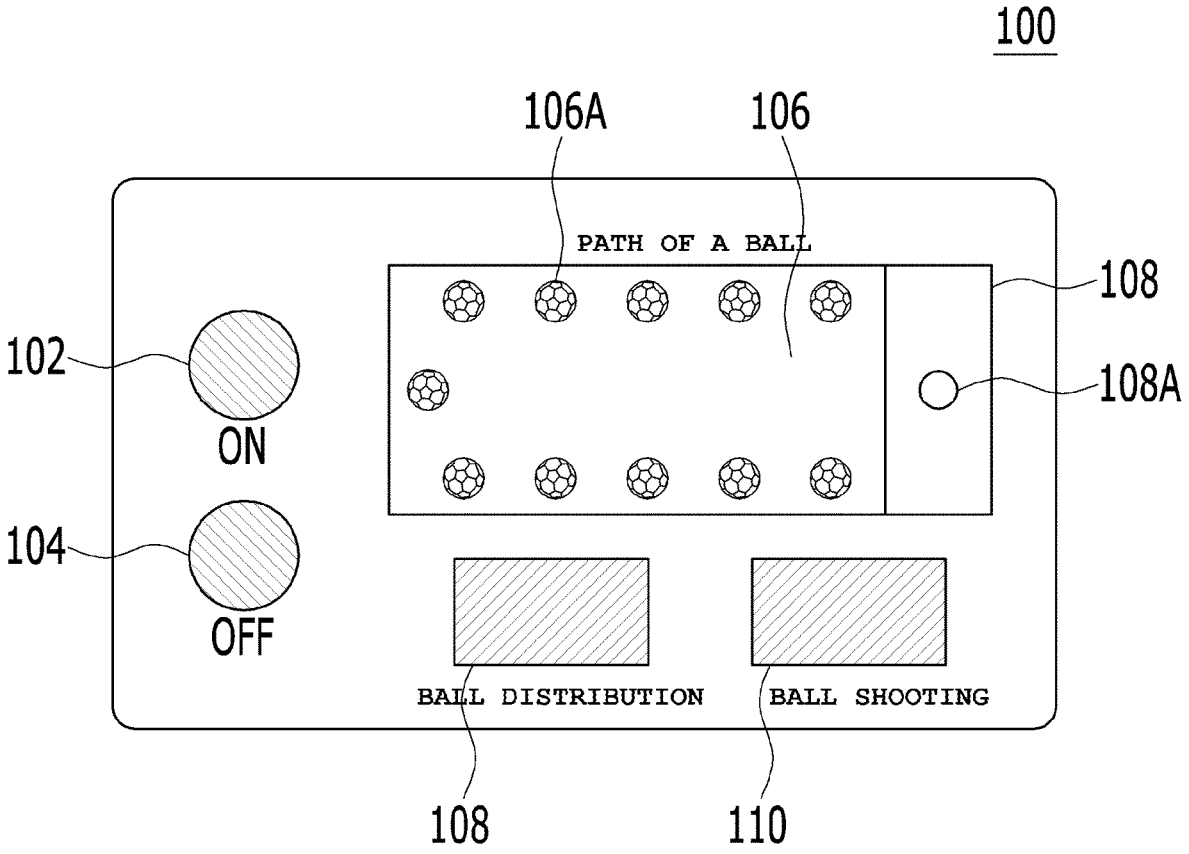
FIG. 4 is a diagram showing an example of a control panel configured to control the ball distribution and shooting of the multi-sport court according to the present invention.

FIG. 4 shows an example of a control panel 100 configured to control the ball distribution and shooting of the multi-sport court 1 according to the present invention. The control panel 100 includes an on button 102 and an off button 104. When the on-button 102 is pressed and then a ball distribution button 108 is pressed, each gate of the ball distribution line 50 is operated to perform ball supply for each type of sport. When a ball shooting button 110 is pressed, power to the gate is cut off, all operations are stopped, and a ball is collected in the ball shooting device 30. It is preferable that a dedicated gate is also installed in the ball shooting device 30 and distinguishes between a volleyball ball and a foot volleyball ball.

A main display 106 is formed in the center of the control panel, and an auxiliary display 108 is formed on the right side. LEDs 106A showing the movement of a ball are installed along the rectangular boundary of the main display 106. A sensor (not shown) installed in the control panel 100 detects a chip embedded in the ball, and displays the movement of the ball through the LEDs 106A. For example, one LED 108A is installed in the auxiliary display 108, and indicates that the ball normally reaches the ball shooting device 30.

Although several embodiments of the present invention have been described above, these are examples and are not intended to limit the scope of the present invention. Various modifications may be made for the present invention, and these also pertain to the scope of the present invention.

What is claimed is:

1. A multi-sport court capable of automatically collecting and supplying balls, the multi-sport court comprising:

an inclined surface that is inclined in one direction, wherein the inclined surface has a left side and a right side;

a net detachably installed between a pair of center posts on the inclined surface, wherein each of the pair of center posts is located at a center portion of each of the left and the right sides of the inclined surface, respectively;

a soccer goal installed in a center of one end side of the inclined surface;

a basketball goal installed on a center of an upper portion of the soccer goal in an integrated manner;

a concave ball transfer line that is inclined in a horizontal direction and that is formed on an end line of the inclined surface on which the soccer goal is installed;

a ball distribution line horizontally extending at an aerial height and inclined in a direction opposite to a direction in which the ball transfer line is inclined;

a ball lifting device that is configured to lift a ball vertically and that is installed to communicate with the ball transfer line, wherein an upper end of the ball lifting device communicates with one end of the ball distribution line;

a plurality of gates installed at predetermined intervals on the ball distribution line; and a ball shooting device configured to shoot a volleyball ball or foot volleyball ball as a served ball, wherein an opposite end of the ball distribution line communicates with the ball shooting device.

2. The multi-sport court of claim 1, wherein the plurality of gates includes first to fourth gates (G1, G2, G3, and G4), a soccer ball, a basketball ball, a volleyball ball, and a foot volleyball ball pass through a first gate (G1), a second gate (G2), a third gate (G3), and a fourth gate (G4), respectively, move and fall to the inclined surface, and chips acting as electronic signal sensors configured to allow types of balls to be identified are embedded in the balls.

3. The multi-sport court of claim 2, wherein the ball shooting device is suspended in the air, and a first opening, which is a shooting exit for a volleyball ball, is formed in an upper part of a standby post and a second opening, which is a shooting exit for a foot volleyball ball, is formed in a lower part of the standby post.

4. The multi-sport court of claim 2, wherein each of the gates includes a solenoid valve provided on both sides of a passage of an exit and a screen configured to act as a partition that is rotated by an operation of the solenoid valve, and a sensor configured to identify a chip embedded in a ball is attached to a side wall of an exit side near the solenoid valve.

* * * * *